US005594967A

United States Patent [19]

Morton et al.

[11] Patent Number: 5,594,967

[45] Date of Patent: Jan. 21, 1997

[54] BAYONET SYSTEM INCLUDING BAYONET WITH INTEGRAL TANG AND SCABBARD WITH HAND PROTECTION

[75] Inventors: Randolph J. Morton, Coronado; Brett Seber; Curtiss English, both of Escondido; Mark DeFelice, Santee, all of Calif.

[73] Assignee: Buck Knives, Inc., El Cajon, Calif.

[21] Appl. No.: 372,179

[22] Filed: Jan. 12, 1995

[51] Int. Cl.[6] ..... B25B 1/22

[52] U.S. Cl. ..... 7/134; 7/158; 30/151; 30/138; 42/86

[58] Field of Search ..... 7/134, 151, 158, 7/117, 125, 166; 30/342, 138, 151, 162, 224, 232, 357, 353, 355; 42/86

[56] References Cited

U.S. PATENT DOCUMENTS 689,135 12/1901 Shaw ..... 30/342

3,842,458 10/1974 Bauer ..... 7/134

4,387,510 6/1983 Hashemifard ..... 30/342 X 4,821,356 4/1989 Finn ..... 7/134

*Primary Examiner*—James G. Smith

*Attorney, Agent, or Firm*—Gregory Garmong

[57] ABSTRACT

A bayonet system includes a bayonet and a scabbard in which the bayonet is received for storage. The bayonet is formed with an integral blade-and-tang unit. A plastic handle is molded over the tang, with a portion of the tang protruding from a butt end of the handle. A latch plate is attached to the butt end of the handle assembly by a radial rivet to the protruding portion of the tang. The latch plate includes a pair of retainer arms fixed to the latch plate with pins that can be driven out to effect removal of the release arms. The scabbard has a housing with an integral load assembly at its upper end, integral recessed tie-down loops adjacent to its lower end, and an integral hand guard extending from one side at a position intermediate the upper end and the lower end.

14 Claims, 4 Drawing Sheets

BAYONET SYSTEM INCLUDING BAYONET WITH INTEGRAL TANG AND SCABBARD WITH HAND PROTECTION

BACKGROUND OF THE INVENTION

This invention relates to bayonet systems, and, more particularly, to an improved bayonet having an integral tang and features to increase its strength, and to an improved scabbard.

A bayonet is a specialized type of knife that can be used as a knife but also has the capability to be affixed to the end of a rifle. In either case, the bayonet can be employed for cutting, spearing, prying, and other functions. Bayonets were originally little more than a long blade having a handle that could be affixed to cooperating structure on a rifle when necessary.

Current designs, such as the US Army's M9 bayonet system, have been engineered as bayonet systems that include both the bayonet and the scabbard in which it is held. The bayonet includes a blade that has a cutting edge on the blade front, a saw on the blade back, a blood groove on one side, a hole through the blade near its tip to allow the blade to be used cooperatively with its scabbard in a wire cutting function, and a pointed tip. The blade is attached to an elongated tang by a threaded connector. A prefabricated guard and a prefabricated handle fit over the tang. A latch plate used in attaching the bayonet to the rifle is affixed to a butt end of the tang with a cap screw. The scabbard is used to store the blade. It also has a wire cutter head that cooperates with the blade to form a wire cutter, and other features as well.

The M9 bayonet system functions well in its role. However, as with all implements, there is always a desire to improve its functioning as well as to decrease its cost of manufacture. The present invention provides such improvements.

SUMMARY OF THE INVENTION

The present invention provides an improved bayonet system. The bayonet is significantly stronger than prior bayonets of similar configuration. It also is less costly to manufacture. The scabbard is also stronger, more convenient to use, and less costly. Additionally, the scabbard design reduces the risks of the user being injured when the scabbard and bayonet are used together as a wire cutter.

In accordance with the invention, a bayonet system comprises a one-piece, integral blade-and-tang unit having a blade, an elongated tang having a tang axis, and a blade shoulder between the blade and the tang. A guard having a guard opening therein is sized to fit over that portion of the tang adjacent to the blade shoulder. A plastic handle is molded over a portion of the tang. The tang and the handle together comprise a handle assembly. The plastic handle has a length less than that of the tang such that a butt end of the tang protrudes from a butt end of the plastic handle. A latch plate assembly is sized to register with the butt end of the handle assembly with a latch-plate tang bore sized to fit over the butt end of the tang.

There is further a means for attaching the latch plate assembly to the butt end of the handle assembly. The means for attaching preferably includes means for attaching the latch plate assembly to that portion of the tang within the latch-plate tang bore, most preferably a radial rivet of the latch plate to the tang. The latch plate assembly typically includes a latch plate and two arms pivotably attached to the latch plate. The means for attaching the latch plate assembly can include in this case at least one handle pin bore extending into the handle from the butt end of the handle and parallel to the tang axis, at least one latch-plate pin bore extending through the latch plate assembly parallel to the tang axis and aligned with the handle pin bore, and a latch-plate attachment pin sized to extend through each aligned pair of latch-plate pin bore and handle pin bore with a press fit. The latch-plate attachment pins are the pivot pins for the arms, so that removal of the latch-plate attachment pins by driving them into the handle permits the retainer arms to be removed.

The use of the one-piece blade-and-tang unit, in combination with a molded handle, increases the strength of the bayonet. There are also fewer parts to manufacture and assemble. Attaching the latch plate assembly to the butt of the handle assembly by radial riveting and press-fit pins provides a secure, strong attachment. Various other features are supplied to improve the strength and utility of the bayonet.

The bayonet system further comprises a scabbard including an elongated blade receptacle housing having a front side, a back side, two oppositely disposed narrow edges, a closed lower end, and an open upper end. A load assembly is joined, preferably integrally, to one side of the blade receptacle housing at the upper end thereof. A hand guard extends from one edge of the housing at a location intermediate between the lower end and the upper end of the housing, and a wire cutter head is fixed to the lower end of the housing. There is desirably a sharpening plate, having a flat sharpening face, recessed into one side of the scabbard, and an integral guide positioned adjacent to the sharpening plate with a guide face defining an angle of from about 10 to about 20 degrees between the guide face and the flat sharpening face.

The bayonet system of the invention improves upon the existing bayonet systems of this type, with increased utility and decreased manufacturing cost. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENTS

Figure 9:
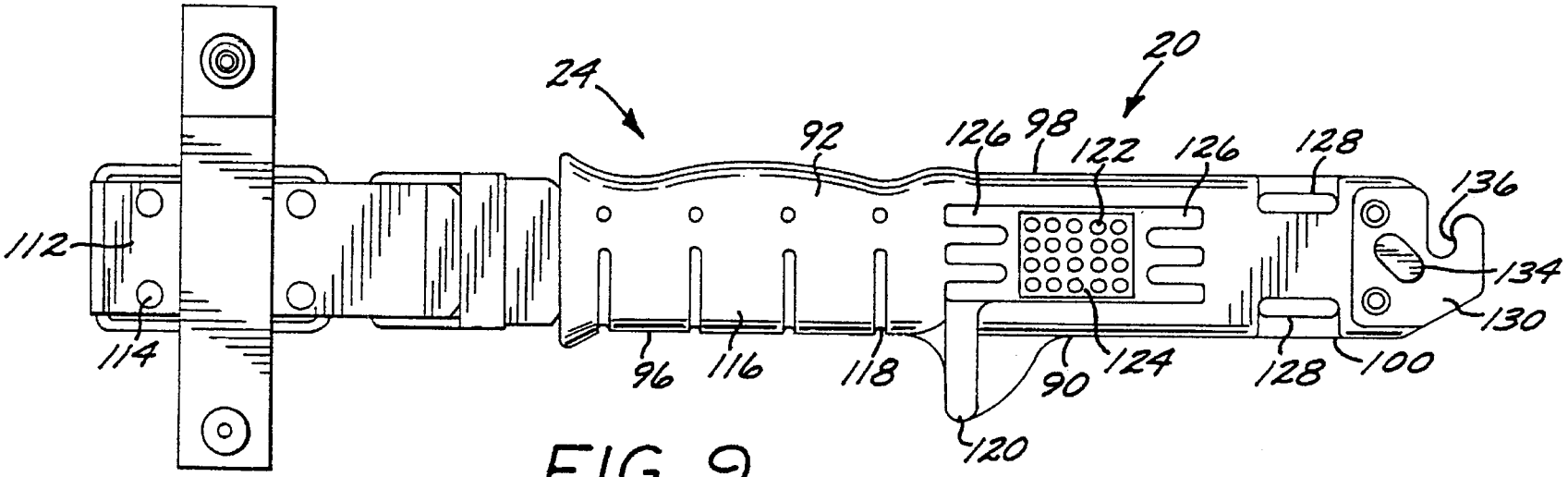
FIG. 9 is a side elevational view of a scabbard according to the invention.
Figure 10:
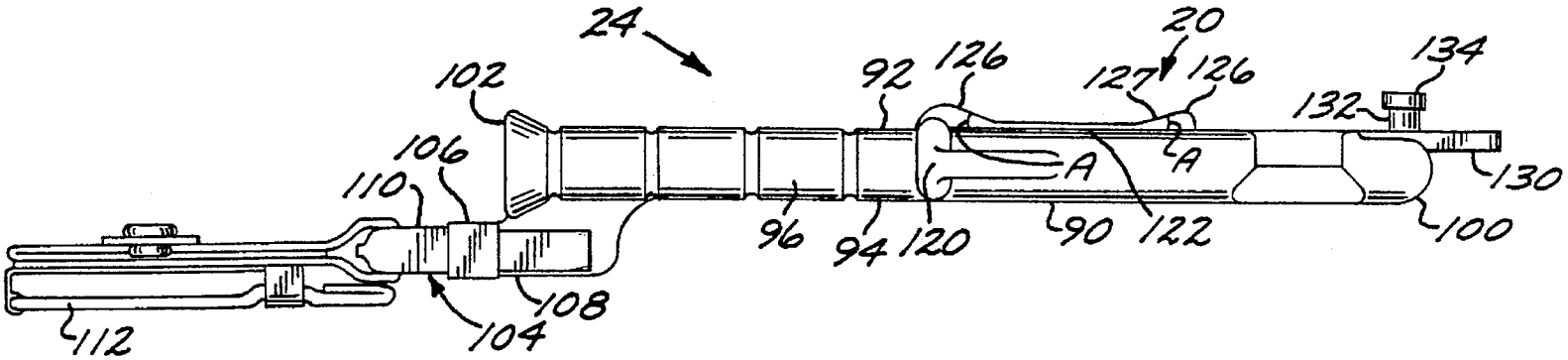
FIG. 10 is an edge elevational view of the scabbard of FIG. 9.

A bayonet system 20 in accordance with the invention includes a bayonet 22 shown in FIGS. 1–8 and a scabbard 24 shown in FIGS. 9–10. The bayonet 22 and scabbard 24 are illustrated as they are used cooperatively as a wire cutter in FIG. 11. Referring to FIGS. 1–8, the bayonet 22 includes a one-piece, integral blade-and-tang unit 26 having a blade 28 and an integral tang 30. The blade-and-tang unit 26 is elongated and extends along a tang axis 31. A blade shoulder 32 separates the blade 28 from the tang 30. The blade 28 has a blade front 34 including a sharpened cutting edge 36, and a blade back 38, which includes a saw 40 in the preferred embodiment. The cutting edge may be ground in a flat, hollow or other operable fashion. The cutting edge 36 is preferably flat ground, rather than hollow ground, inasmuch as the flat ground edge is stronger than the hollow ground cutting edge. The bottoms of the grooves that define the saw teeth are radiused to a minimum radius of no less than about 0.03 inches to reduce stress concentrations.

The cutting edge 36 terminates in a rear cutting edge margin 37, and the saw 40 terminates in a rear saw margin 41. The rear cutting edge margin 37 is radiused to about 0.06 inch minimum radius, to avoid a stress concentration at this location. The rear cutting edge margin 37 and the rear saw margin 41 are laterally separated by a distance D, measured parallel to the tang axis 31. The distance D is at least about ¼ inch. In the standard M9 bayonet, the rear cutting edge margin and the rear saw margin are nearly aligned, and the value of D for such a standard M9 bayonet would be less than ¼ inch. This alignment has now been found to contribute to a stress concentration that can lead to premature failure of the blade. The displacement D of at least about ¼ inch, according to the present invention, results in improved strength of the blade. The value of D can be any value greater than about ¼ inch, but is preferably no more than about ½ inch. Larger values of D are acceptable, but not preferred because the useful length of the saw 40 becomes shortened.

At the forward end of the saw 40, the saw structure is tapered into the side of the blade 28 with a flat region 42. The flat tapering is selected to permit the bayonet blade 28 to readily penetrate metallic structures such as aluminum sheet. The forwardmost portion 44 of the blade back 38 is flat and inwardly tapered on each side of the blade. The forwardmost portion 46 of the cutting edge 36, which is flat ground, extends to a blade tip 48.

Figure 4:
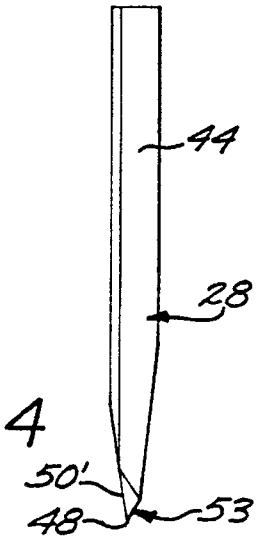
FIG. 4 is a plan view of the spear point of the blade.
Figure 3:
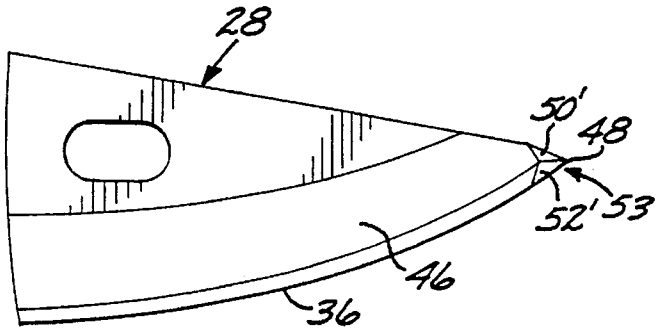
FIG. 3 is an elevational view of the spear point of the blade similar to view of FIG. 2, except from a second side of the blade.
Figure 2:
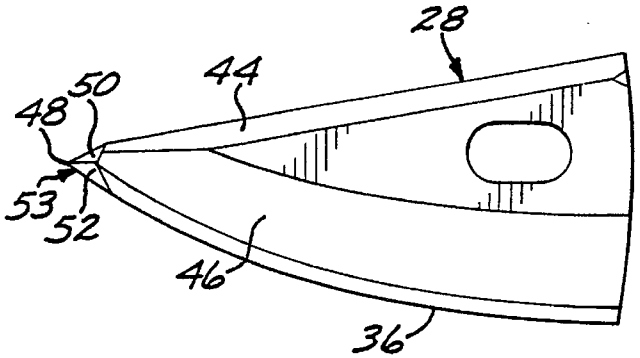
FIG. 2 is a detail of FIG. 1, illustrating in elevational view the spear point of the bayonet from a first side of the blade.

At the blade tip 48, the portions 44 and 46 are terminated by planar regions 50 and 52, respectively, on a first side of the blade 28 shown in FIG. 2, and by planar regions 50' and 52', respectively, on a second side of the blade 28 shown in FIG. 3 and FIG. 4, forming a spear tip 53. This preferred spear tip 53 is formed by four planar regions, but it could also be formed of more planar regions. The spear tip 53, formed by planar regions produced by grinding and thence slightly shortening the blade 28 at its tip 48, is stronger than conventional tips, without sacrificing any penetrating capability. Tests have shown that the bayonet 22 with spear tip 53 can be dropped point first onto concrete from a height of 8 feet without breaking the blade, whereas the sharply pointed blade on a conventional bayonet will fracture in the same test.

Another feature of the preferred form of the present bayonet 22 is the absence of a blood groove, or a significant reduction in its size as compared with prior bayonets. Prior bayonets have traditionally incorporated blood grooves. The blood groove in prior bayonets is a depression on one side of the blade elongated in the direction parallel to the tang axis 31. Testing has established that the blood groove is not necessary for the bayonet to perform its principal functions. The blood groove, particularly when positioned adjacent to the saw teeth, has the undesirable effect of weakening the blade and increasing stress concentrations in the blade, which reduce the suitability of the blade for functions such as prying. Nevertheless, the bayonet is operable with a blood groove, and one may optionally be furnished on the side of the bayonet.

Figure 11:
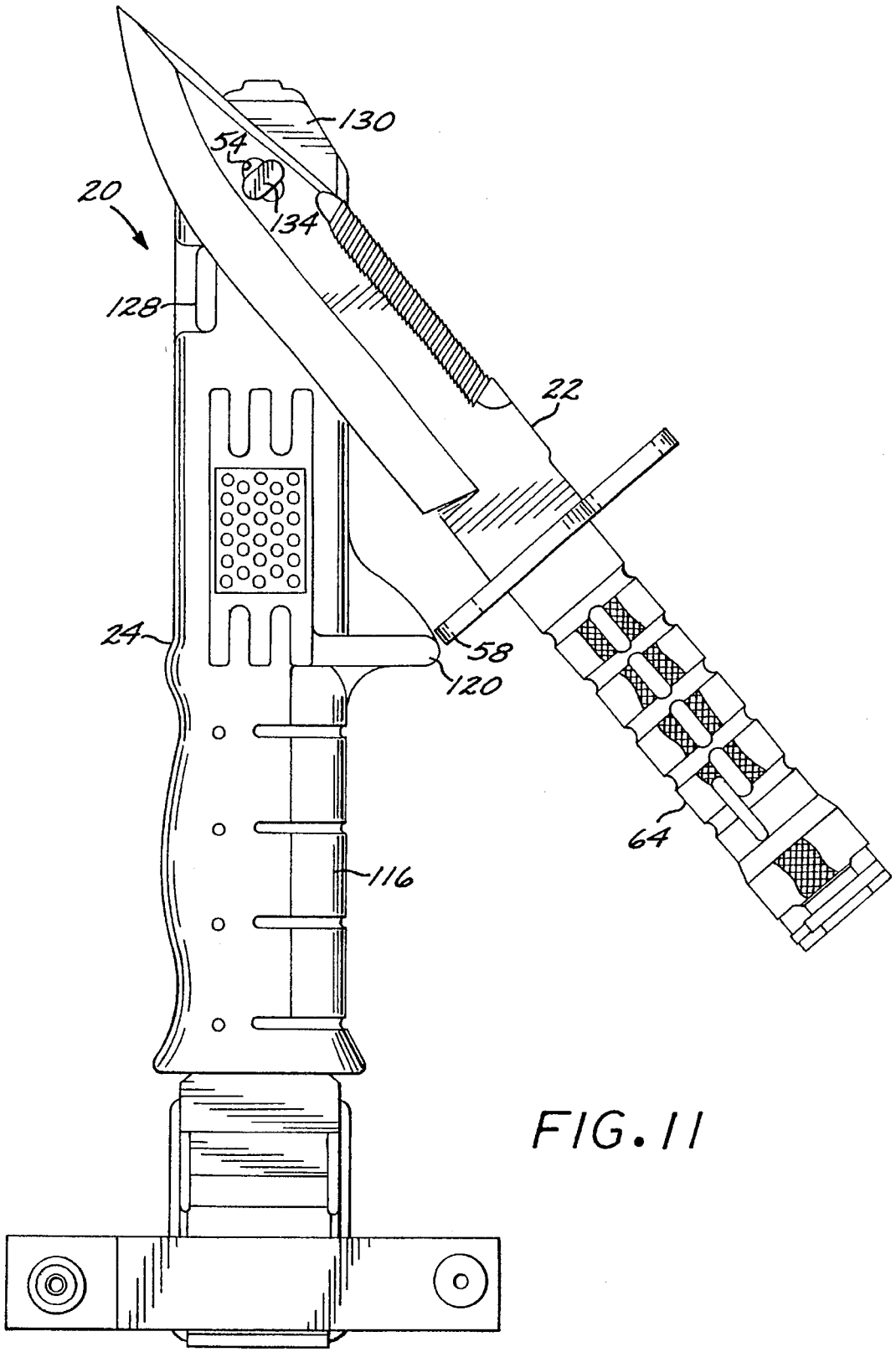
FIG. 11 is an elevational view of the bayonet system illustrating the bayonet and scabbard used together as a wire cutter.

An oval wire cutter pivot hole 54 is provided through the blade 28 about 1–2 inches behind the tip 48. The pivot hole 54 cooperates with a post on the scabbard 24 to permit the bayonet and scabbard to function together as a wire cutter when assembled with the post through the pivot hole 54, as shown in FIG. 11. In the prior M9 design, the pivot hole was formed with a sharp cut through the side of the blade 28. In the present approach, the pivot hole 54 is radiused along its periphery on both sides of the blade, with a radius of about 0.005–0.010 inches.

The tang 30, which is forged from steel integrally with the blade 28, comprises a flat metallic piece with a series of gradual step-downs 56 in lateral extent. The step-downs 56 are radiused with a minimum of about 0.06 inches to avoid excessive stress concentrations in the tang 30. In many prior designs, the tang, which was not integral with the blade, had similar step-downs that were in the form of sharp corners.

Figure 1:
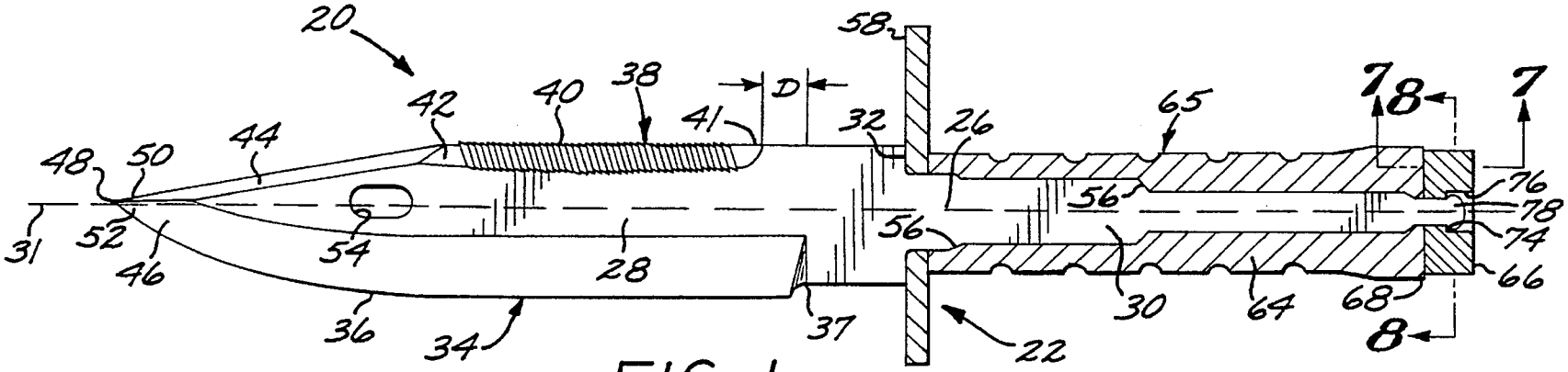
FIG. 1 is a side view of a bayonet according to the invention, with the blade shown in elevation and the handle assembly shown in section.
Figure 5:
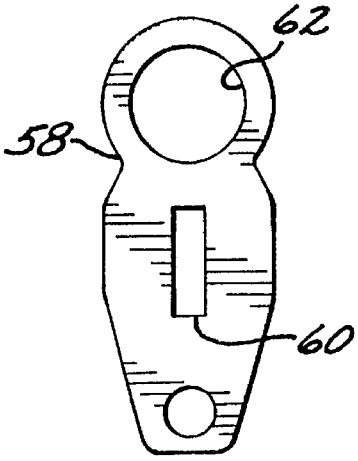
FIG. 5 is an elevational view of a guard used on the bayonet.
Figure 6:
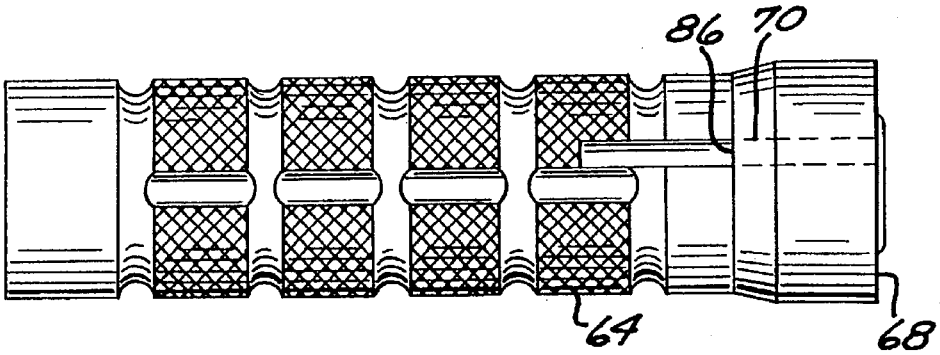
FIG. 6 is an elevational view of the handle of the bayonet.

A guard 58, shown in side sectional view in FIG. 1 and in rear elevation in FIG. 5, is a flat, somewhat oval, piece of metal which has a rectangular guard opening 60 therethrough. The guard opening 60 fits over the portion of the tang 30 that is directly adjacent to the blade 28, and against the blade shoulder 32. The guard 58 protects the hand of the user when the bayonet 22 is used as a knife that is not attached to a rifle. An attachment bore 62 fits over the barrel of the rifle when the bayonet 22 is attached to the rifle, so that the guard is a load-bearing member in this application.

A handle 64 of the bayonet 22 is preferably molded over the tang 30 to form a handle assembly 65. The handle 64 is preferably formed of a plastic such as a glass-filled nylon. The preferred glass-filled nylon is Zytel plastic available from DuPont. This plastic is preferably injection molded over the tang 30 using conventional injection molding machinery and tools. The plastic can also be molded over the tang 30 by other molding techniques, such as casting and cold molding, and the term "molding" as used herein is intended to encompass all such molding techniques. By contrast, in the prior M9 bayonet the handle was formed as a separate part, loosely slipped over the tang, and fastened to the tang with a cap screw. That approach is operable with the present bayonet, but is not preferred because of its lower strength as compared with the molded handle design.

The preferred form of the present bayonet construction is much stronger than that of the prior M9 design. The one-piece, integral blade-and-tang configuration, with the stress-reducing features discussed previously, does not have the potential sources of weakness present in many prior bayonet configurations. Elimination of a threaded connection between the blade and the tang eliminates the threaded structure which is a potential source of premature failure under load. Molding the handle to the tang packs the handle material tightly to the tang and eliminates possible looseness of the handle on the tang that can occur when the handle is fastened to the tang with a threaded or other type of connector. Additionally, the present approach is less expensive than the prior approach, because fewer pieces are required and assembly costs are reduced. The corrosion resistance of the unit is also improved.

The bayonet differs from a conventional knife in several respects, one of which is the requirement for a latch plate assembly 66 affixed to a butt end 68 of the handle assembly 65, as shown in FIG. 1. The latch plate assembly 66 removably attaches to a fixture on the rifle (not shown), when the bayonet 22 is to be mounted on the rifle. The latch plate assembly 66, shown in detail in FIG. 8, includes certain mandated features so as to be compatible with the fixture on the rifle. The latch plate assembly 66 includes a latch plate 80, a pair of retainer arms 82 pivotably joined to the latch plate 80, and a spring 84 that biases the ends of the receiver arms outwardly. The design of these features of the latch plate assembly 66 itself does not form part of the present invention. However, in the past it has been conventional to attach the latch plate to the butt end of the handle with a cap screw that was threadably received in the rearward end of the tang. While operable, this design permits the latch plate to become loosened and was also relatively weak.

The present bayonet 22 includes means for attaching the latch plate assembly 66 to the butt end 68 of the handle 66. Two attachment structures are provided which can be used separately or together, preferably together for strength.

The primary attachment structure attaches the latch plate assembly 66 directly to a butt end of the tang 30. The handle 64 is preferably molded around the tang 30 such that the tang 30 protrudes from the butt end 68 of the handle by a small amount, typically about ⅜ inch. The latch plate 80 has a tang bore 74 with a counterbore 76 which fits over the butt portion of the tang 30 that protrudes from the butt end 68. The butt end of the tang 30 is initially forged to be straight so that the bore 74 can be slipped over the butt end of the tang. During manufacturing, the protruding portion of the tang 30 residing within the counterbore 76 is radially upset to form a button 78 into the counterbore 76 of the latch plate 66. The button 78 holds the latch plate assembly 66 firmly to the tang 30.

Figure 7:
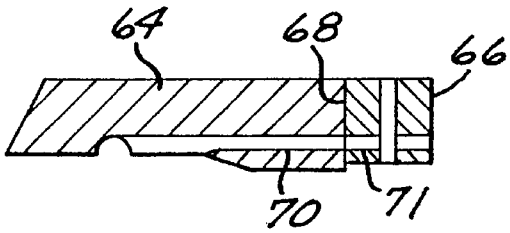
FIG. 7 is a sectional detail of the bayonet handle assembly of FIG. 1, taken generally along lines 7—7 of FIG. 1.
Figure 8:
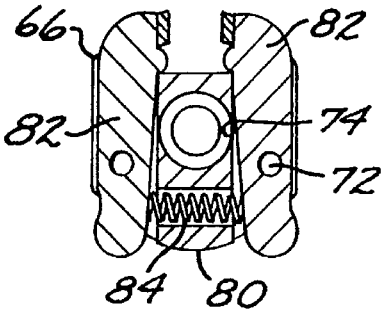
FIG. 8 is a sectional view of a latch assembly used on the bayonet of FIG. 1, taken generally on lines 8—8 of FIG. 1.

It is desired to have the capability to remove the retainer arms 82 from the latch plate assembly 66 so as to be able to replace the spring 84 if it is broken. To provide this capability for removal, as well as to additionally strengthen the connection between the latch plate assembly 66 and the handle assembly 65, a further means for attachment has been developed. In this structure, two handle pin bores 70 are molded into the interior of the handle 64 as shown in FIG. 7. The bores 70 extend from the butt end 68 of the handle 64 inwardly into the handle 64 and parallel to the tang axis 31 for a distance of about ¼ inch. The handle pin bores 70 desirably, but not necessarily, penetrate through the sides of the handle 64 at their forwardmost ends, see numeral 86 of FIG. 6. The latch plate assembly 66 has a pair of latch-plate pin bores 71 therethrough, each bore 71 being aligned with one of the bores 70. A latch-plate attachment pin 72, preferably a roll pin, is sized to fit through each bore 70 and into the respective bore 71 with a press fit. The pins 72 form the pivot pins for the two retainer arms 82. The retainer arms 82 are firmly but pivotably held in place to the latch plate 80 by these pins 72. The retainer arm 82 can be detached from the latch plate 80 by driving its pin 72 into the bore 70, so that the pin 72 no longer engages the bore 71 and the retainer arm 82. By driving the pin 72 forwardly through the opening 82, the pin 72 can be removed completely from the bayonet 22 so that, when the retainer arm 82 is to be reassembled to the latch plate assembly 66, a new pin 72 can be press fit into the bores 70 and 71.

FIGS. 9–10 illustrate a preferred embodiment of the scabbard 24. The scabbard 24 forms an important part of the bayonet system, inasmuch as it provides for storage and sharpening of the bayonet 22. The bayonet 22 and scabbard 24 also cooperate to form a wire cutter, as shown in FIG. 11.

The scabbard 24 comprises an elongated, hollow blade receptacle housing 90 whose interior is dimensioned to receive the blade 28 of the bayonet 22 therein, with the handle 64 extending therefrom. The housing 90 is preferably made of glass-filled nylon, most preferably Zytel plastic. The housing 90 includes a first side 92, a second side 94, a first edge 96, and a second edge 98, all of which extend the length of the housing. The sides 92 and 94 are relatively wide, and the edges 96 and 98 are relatively narrow. A lower end 100 of the housing 90 is closed, and an upper end 102 is open to receive the blade 28 therein.

A load assembly 104 is preferably integrally joined to the second (back) side 94 of the housing 90 at the upper end 102 of the housing. This joining is accomplished by injection molding the housing 90 and a portion of the load assembly 104 as a single piece. The load assembly 104 provides the means for carrying the scabbard 24 from the belt of the user in a detachable manner. The load assembly 104 includes a buckle 106, preferably a Nexius buckle, having a first buckle side 108 and a second buckle side 110. The first buckle side 108 is integrally joined to the housing 90, as illustrated, and the second buckle side 110 buckles to the first buckle side 108. The second buckle side 110 of the buckle 106 is attached to a clip 112 such as a Bianchi clip with four rivets 114. Although the use of an integral load assembly is preferred, a conventional load assembly with the buckle attached to the scabbard by webbing may be used.

The scabbard 24 has a textured hand grip 116 that provides positive gripping of the scabbard 24 when it is grasped for removal of the bayonet or when it is used as a component of the wire cutter. The hand grip 116 preferably has a series of grooves 118 extending circumferentially around the exterior of the housing 90.

A hand guard 120 extends outwardly from the first edge 96 of the housing 90 at a front margin of the hand grip 116. The hand guard 120 preferably extends outwardly by about 1 inch. The hand guard 120 acts as a stop for the bayonet 22 when the bayonet is assembled to the scabbard for use as a wire cutter, as shown in FIG. 11. The user of the wire cutter holds the housing 90 by the hand grip 116 in one hand, and holds the bayonet 24 by its handle 64 in the other hand. In the prior design that does not have the hand guard 120 or other stop, if the wire cutter is used improperly it would be possible to close the wire cutter so far that the hand of the user could be pinched between the scabbard 24 and the bayonet 22, or even cut by the cutting edge 36 of the bayonet. In the present approach, the hand guard 120 stops against the guard 58 of the bayonet 22 before the two can be closed together such that these injuries could occur. The hand guard 120 also provides a natural forward end to the handle 116, so that the user's hand is properly positioned by feel on the scabbard during wire cutting, an important advantage when the wire cutter is to be used at night.

A sharpening plate 122 is recessed into the first (front) side 92 of the housing 90. The sharpening plate 122 includes a sharpening face 124 made of organic or diamond material. The sharpening plate 122 is used to sharpen the cutting edge of the bayonet as needed. Because the sharpening may be accomplished under adverse conditions, a guide 126 is provided on each side of the sharpening plate 122 to ensure that the blade 28 of the bayonet 22 is held at the proper angle for optimal sharpening of the cutting edge 36. The guide 126 comprises two inclined guide faces 127, one on either end of the sharpening plate 122. Both side edges of the cutting edge 36, one at a time, are guided as they are sharpened by holding the side of the blade 28 against the guide face 127 as the sides of the cutting edge 36 are contacted to the sharpening face 124 during sharpening. The angle of inclination A of the guide faces 127 with respect to the sharpening face 124 is selected to be from about 10 to about 20 degrees, most preferably about 15 degrees, to ensure optimal sharpening of the cutting edge.

Leg-attachment tie-down loops 128 are molded into the housing 90 near the lower end 100 thereof. A piece of web material (not shown) is passed through the tie-down loops to hold the housing 90 securely to the leg of the user. The tie-down loops 128 are recessed so that the web material cannot interfere with the operation of the wire cutter and possible be itself cut during the wire cutting operation.

A wire-cutter head 130 is fixed to the housing 90 at its lower end 100. The wire-cutter head 130 includes a wire-cutter post 132 extending upwardly above the first side 92 of the housing 90. The post 132 has a button 134 thereon. A hook-like wire receiver 136 forms the lower end of the wire-cutter head 130. When the bayonet system 20 is to be used as a wire cutter as shown in FIG. 11, the head 132 is inserted through the pivot hole 54 on the bayonet 22. A piece of wire to be cut is inserted into the wire receiver 136 when the housing 90 and the handle 64 are well separated. The user moves the housing and the handle toward each other to the position shown in FIG. 11, severing the wire. The hand guard 120 protects the hand of the user by preventing the bayonet 22 from coming too close to the hand grip 116.

The blade-and-tang unit 26 is made from steel, preferably a steel such as 425 modified steel. The steel is heat treated by austenitizing at a temperature of about 1975° F., and then double tempering to a blade Rockwell C hardness of from about 54 to about 56 and a tang Rockwell C hardness of from about 36 to about 40. The temper heat treatment preferably includes a tempering of the integral blade and tang at 450° F. for 3 hours, followed by annealing the tang at 1350° F. for 45 seconds, followed by tempering the blade and tang at 475°–500° F. for 3 hours. The blade 28 is desirably given a non-reflective, dull black finish by providing a titanium oxide or titanium nitride coating.

The guard 58 is preferably made from 410 martensitic stainless steel. The stationary portion of the latch plate 66 is preferably made of 416 martensitic stainless steel and the pivoting retainer arms are made of 410 HC martensitic stainless steel. The pins 72 are preferably made from 420 martensitic steel. The guard 58, latch plate 66, and pins 72 are all desirably given a titanium oxide or titanium nitride coating.

The present invention provides an bayonet system that meets all US Government bayonet specifications but has an improved structure and performance as compared with prior bayonet systems. Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A bayonet system comprising a bayonet including:

a one-piece, integral blade-and-tang unit having a blade, an elongated tang having a tang axis, and a blade shoulder between the blade and the tang, a guard having a guard opening therein sized to fit over that portion of the tang adjacent to the blade shoulder, a plastic handle joined to a portion of the tang, the tang and the handle together comprising a handle assembly, the plastic handle having a length less than that of the tang such that a butt end of the tang protrudes from a butt end of the plastic handle, a latch plate assembly sized to register with the butt end of the handle assembly, the latch plate assembly including a latch plate having a latch-plate tang bore sized to fit over the butt end of the tang, and means for attaching the latch plate to the butt end of the handle assembly, wherein the means for attaching includes a handle pin bore extending into the handle from the butt end of the handle and lying parallel to the tang axis, a latch-plate pin bore extending through the latch plate assembly parallel to the tang axis and aligned with the handle pin bore, and a latch-plate attachment pin sized to extend through the aligned pair of latch-plate pin bore and handle pin bore with a press fit; and a scabbard in which the bayonet is received for storage.

2. The bayonet system of claim 1, wherein the means for attaching the latch plate to the butt end of the handle assembly includes means for attaching the latch plate to that portion of the butt end of the tang disposed within the latch-plate tang bore.

3. The bayonet system of claim 2, wherein the means for attaching the latch plate to that portion of the butt end of the tang disposed within the latch-plate tang bore includes a radial rivet of the tang to the latch plate.

4. The bayonet system of claim 1, wherein the blade includes a blade front having a cutting edge with a rear cutting edge margin; and a blade back having a saw edge with a rear saw edge margin, the rear cutting edge margin and the rear saw edge margin being displaced from each other in the direction parallel to the tang axis by at least about ¼ inch.

5. The bayonet system of claim 1, wherein the blade front has a flat ground cutting edge.

6. The bayonet system of claim 1, wherein the bayonet has no blood groove.

7. The bayonet system of claim 1, wherein the plastic handle is molded to the portion of the tang.

8. A bayonet system comprising a bayonet including:

a one-piece, integral blade-and-tang unit having a blade having a spear point formed of a plurality of planar surfaces, an elongated tang having a tang axis, and a blade shoulder between the blade and the tang, a guard having a guard opening therein sized to fit over that portion of the tang adjacent to the blade shoulder, a plastic handle joined to a portion of the tang, the tang and the handle together comprising a handle assembly, the plastic handle having a length less than that of the tang such that a butt end of the tang protrudes from a butt end of the plastic handle, a latch plate assembly sized to register with the butt end of the handle assembly, the latch plate assembly including a latch plate having a latch-plate tang bore sized to fit over the butt end of the tang, and means for attaching the latch plate to the butt end of the handle assembly; and a scabbard in which the bayonet is received for storage.

9. A bayonet system comprising a scabbard including an elongated blade receptacle housing having a front side, a back side, two oppositely disposed narrow edges, a closed lower end, and an open upper end, a load assembly joined to one side of the blade receptacle housing at the upper end thereof, a hand guard extending from one edge of the housing at a location intermediate between the lower end and the upper end of the housing, and a wire cutter head fixed to the lower end of the housing; and a bayonet sized to fit within the elongated blade receptacle housing.

10. The bayonet system of claim 9, further including a sharpening plate recessed into one side of the scabbard and having a flat sharpening face, and a guide positioned adjacent to the sharpening plate, the guide having a guide face defining an angle of from about 10 to about 20 degrees between the guide face and the flat sharpening face.

11. The bayonet system of claim 9, wherein the load assembly is integrally joined to one side of the blade receptacle housing.

12. The bayonet system of claim 9, wherein the load assembly includes a buckle having a first side and a second side thereof, and wherein the first side of the buckle is integrally attached to the blade receptacle housing.

13. The bayonet system of claim 9, further including a pair of leg-attachment tie-down loops integral with the housing, the tie-down loops being recessed into the back side of the housing at a location adjacent to the lower end of the housing.

14. A bayonet system comprising a bayonet including:

a one-piece, integral blade-and-tang unit having a blade, an elongated tang having a tang axis, and a blade shoulder between the blade and the tang, wherein the blade includes a blade front having a cutting edge with a rear cutting edge margin, and a blade back having a saw edge with a rear saw edge margin, the rear cutting edge margin and the rear saw edge margin being displaced from each other in the direction parallel to the tang axis by at least about ¼ inch, a guard having a guard opening therein sized to fit over that portion of the tang adjacent to the blade shoulder, a plastic handle joined to a portion of the tang, the tang and the handle together comprising a handle assembly, the plastic handle having a length less than that of the tang such that a butt end of the tang protrudes from a butt end of the plastic handle, a latch plate assembly sized to register with the butt end of the handle assembly, the latch plate having a latch-plate tang bore sized to fit over the butt end of the tang, and means for attaching the latch plate to the butt end of the handle assembly; and a scabbard in which the bayonet is received for storage.

* * * * *